US007238233B2

(12) United States Patent
Maiwald et al.

(10) Patent No.: US 7,238,233 B2
(45) Date of Patent: Jul. 3, 2007

(54) CLEANING DEVICE FOR A GLUE-SPREADING ELEMENT

(75) Inventors: Berthold Maiwald, Schwarzenbek (DE); Torsten Mörke, Dissau (DE); Karl-Heinz Pawelko, Marschacht (DE)

(73) Assignee: Hauni Maschinenbau AG, Hamburg (DE)

( * ) Notice: Subject to any disclaimer, the term of this patent is extended or adjusted under 35 U.S.C. 154(b) by 440 days.

(21) Appl. No.: 10/300,872

(22) Filed: Nov. 21, 2002

(65) Prior Publication Data

US 2003/0094187 A1 May 22, 2003

(30) Foreign Application Priority Data

Nov. 21, 2001 (DE) ..... 101 57 054

(51) Int. Cl.
*B05C 1/00* (2006.01)
*A24C 5/00* (2006.01)

(52) U.S. Cl. ..... 118/203; 131/289

(58) Field of Classification Search ..... 131/286, 131/289; 156/578; 222/148; 118/203, 302, 118/694; 101/423, 425; 15/256.5, 265.51, 15/265.53, 256.53; 239/106, 114, 115; 347/33, 347/22

See application file for complete search history.

(56) References Cited

U.S. PATENT DOCUMENTS 4,469,043 A 9/1984 Kohler et al.
4,704,308 A * 11/1987 Maneke et al. ..... 427/207.1
4,860,883 A * 8/1989 Knaul et al. ..... 198/495
4,898,187 A * 2/1990 Hinchcliffe et al. ..... 131/284
5,964,257 A * 10/1999 Lin et al. ..... 141/90
6,099,656 A 8/2000 Kustermann et al.
6,312,094 B1 * 11/2001 Ito et al. ..... 347/36
6,348,105 B1 * 2/2002 Heyde et al. ..... 134/19
6,513,897 B2 * 2/2003 Tokie ..... 347/15
6,533,102 B2 * 3/2003 Franzoni et al. ..... 198/495
6,585,348 B2 * 7/2003 Reed et al. ..... 347/29
6,637,857 B2 * 10/2003 Shimizu et al. ..... 347/32
6,699,323 B2 * 3/2004 Tacchi et al. ..... 118/302

FOREIGN PATENT DOCUMENTS

| | | | |
|---|---|---|---|
| CH | 689 545 | A5 | 6/1999 |
| DE | 32 06 665 | A1 | 11/1982 |
| DE | 198 47 713 | A1 | 4/2000 |
| DE | 100 19 930 | A1 | 10/2001 |
| EP | 1 000 863 | A1 | 5/2000 |
| EP | 1 121 869 | A1 | 8/2001 |
| JP | 300 261 | A | 11/1999 |

* cited by examiner

*Primary Examiner*—Brenda A. Lamb
(74) *Attorney, Agent, or Firm*—Venable LLP; Robert Kinberg; Catherine M. Voorhees

(57) ABSTRACT

A cleaning device and method is provided for a glue-spreading element, which spreads glue in a working position onto a material web, in particular a paper web, and which can be moved to a cleaning position inside the cleaning device. At least one scraper element is provided for cleaning the glue-spreading element.

5 Claims, 2 Drawing Sheets

CLEANING DEVICE FOR A GLUE-SPREADING ELEMENT

CROSS-REFERENCE TO RELATED APPLICATION

This application claims the priority of German Patent Application No. 101 57 054.6 filed Nov. 21, 2001, the disclosure of which together with the disclosure of each and every U.S. and foreign patent and patent application mentioned below are incorporated herein by reference.

BACKGROUND OF THE INVENTION

The invention relates to a cleaning device for a glue-spreading element that spreads glue onto a material web, in particular a paper web, while in a working position, and that can be moved into a cleaning position inside the cleaning device. The invention furthermore relates to an arrangement comprising a glue-spreading element and a cleaning device, and to a machine used in the tobacco processing industry, in particular for producing cigarettes or the like, as well as a method for cleaning a glue-spreading element that is moved from a working position for applying glue onto a material web, in particular a paper web, into a cleaning position inside a cleaning device.

German unexamined published application 32 06 665 Al discloses a glue-spreading nozzle which is plunged into a liquid bath for cleaning the nozzle and preserving the glue inside the nozzle. During a break in operations, the nozzle is sealed from air outside of the cleaning device, so that the liquid glue inside the nozzle does not dry or harden. Since the glue nozzle is submerged repeatedly into the same cleaning bath, the liquid becomes increasingly polluted after each dip of the nozzle into the liquid bath.

European Patent Application EP 1 000 863 A1 discloses a glue-spreading element for spreading glue onto packages. The element is cleaned with a rotating roller that functions as a cleaning element and a sealing element for the glue nozzle. The roller is submerged into a water bath for cleaning the nozzle. The water bath and the roller used for this operation also become increasingly polluted.

A glue nozzle head, provided with several nozzles to apply a specific glue pattern onto a continuously moving paper ribbon is also known from German unexamined published application 100 19 930 A1. The paper ribbon provided with the glue pattern is cut into sections to be wrapped around the filter segment of a cigarette.

SUMMARY OF THE INVENTION

Starting with this prior art, it is an object of the present invention to improve the cleaning of glue-spreading elements.

This object is accomplished by providing at least one scraper element for cleaning the glue-spreading element. The glue spreading element is typically a glue discharge nozzle. In particular, hard to clean residues that develop or harden, for example, during the glue application on the glue-application nozzle can be removed with the aid of the scraper element according to the invention. The scraper element thus can scrape off any glue projections that may interfere with the intended glue pattern from the glue-spreading element.

In order to remove glue and/or paper dust deposits from the glue nozzles, it is advantageous if the scraper element can be moved in a linear direction and/or crosswise direction to the glue-spreading element.

The cleaning effect can be increased if the cleaning device is provided with at least one chamber for holding a cleaning liquid. As a result, the glue discharge nozzles and/or the glue-spreading element can be cleaned under airtight conditions while the machines are stopped. In addition, a solvent or other substance that supports the cleaning effect can be added to the liquid inside the chamber.

At least one mechanism for the intake and/or discharge of the liquid, particularly the intake/discharge of fresh water and industrial water, is advantageously provided for exchanging the cleaning liquid inside the chamber of the cleaning device. This mechanism according to the invention permits a quick replacement of dirty liquids so that fresh water, for example, flows into the chamber following the cleaning of the glue-spreading element. The fresh water also ensures an airtight preservation of the glue nozzles until the glue nozzles are once more moved into the working position.

For a modification of the invention, it is furthermore advantageous if at least one sensor is provided for the liquid inside the chamber to indicate the level of the liquid. With this sensor, it is possible to reliably monitor the preservation of a cleaned glue-spreading unit.

Furthermore, it is preferable if the scraper element can be moved hydraulically and/or or pneumatically. Conventional hydraulic or pneumatic movement control can be utilized.

In addition, the preservation of the glue-spreading element following a cleaning operation can be improved by providing at least one sealing mechanism for sealing the chamber. The seal ensures that the liquid inside the chamber is not polluted with dust particles and prevents evaporation of the liquid during extended inactive periods of the machine.

According to another advantageous modification, the cleaning device has at least one overflow outlet. This overflow outlet ensures that any excess liquid can flow off after the chamber is filled and a predetermined liquid level is reached.

It is furthermore preferable if the cleaning device, along with the scraper element, is height-adjustable and/or is provided with at least one mechanism for pressing the scraper element against the glue-spreading element. As a result, the scraper element can be attached under tension to a glue nozzle head, thus making it possible to remove stubborn glue projections. The cleaning device advantageously is height-adjustable for readjusting the scraper element. The pressing mechanism ensures a reliable contact between the scraper element and/or the cleaning device and the glue nozzle during cleaning and preservation. Springs or other tensioning elements can be used as a pressing mechanism.

The object is also accomplished with an arrangement comprising a glue-spreading element and a cleaning device according to the invention, as described above. This arrangement is preferably a single structural unit, thus making it possible to achieve the advantageous effects through a joint operation between glue-spreading element and cleaning device.

One modification of the device provides for at least one mechanism for pivoting the glue-spreading element. As a result, a glue nozzle is inserted into the cleaning device during an interruption in the machine operation and/or when the machine is stopped and is then cleaned. During the start-up of the machine, the pivoting mechanism pivots the glue-spreading element back into the working position.

The object is furthermore accomplished with a method for cleaning a glue-spreading element. The glue-spreading element can be moved from a working position for spreading glue onto a material web, in particular a paper web, into a cleaning position inside a cleaning device. The glue-spreading element can be cleaned with the aid of at least one scraper element. It is furthermore advantageous if the scraper element is moved along the glue-spreading element, in particular hydraulically or pneumatically.

The cleaning effect achieved with the scraper element is increased if at least one liquid is filled into at least one chamber of the cleaning device with the glue-spreading element to be cleaned. A solvent can be used as a cleaning liquid for the glue located on and inside the nozzles of the glue-spreading element.

Another advantage is achieved if the liquid inside the chamber of the cleaning device is replaced after cleaning the glue-spreading element. By providing unused, fresh liquid for the polluted liquid following the cleaning operation, the glue-spreading element is preserved in a watery, non-polluted atmosphere. The airtight seal ensures that during the restart of the machine, the spreading of the glue results in a reliable glue pattern on the paper web immediately after startup.

According to one modification of the invention, the liquid level inside the chamber is indicated and/or monitored.

It is furthermore advantageous if the chamber is emptied before the glue-spreading element is moved into the working position.

This object is also accomplished by a machine in the tobacco processing industry, in particular a machine for producing cigarettes or the like, with a cleaning device as described above.

BRIEF DESCRIPTION OF THE DRAWINGS

The invention is described in the following without limiting the general inventive idea, using an exemplary embodiment and referring to the drawings.

DETAILED DESCRIPTION OF THE INVENTION

In the following Figures, respectively the same or corresponding parts are given the same reference numbers and will not be introduced again.

Figure 1C:
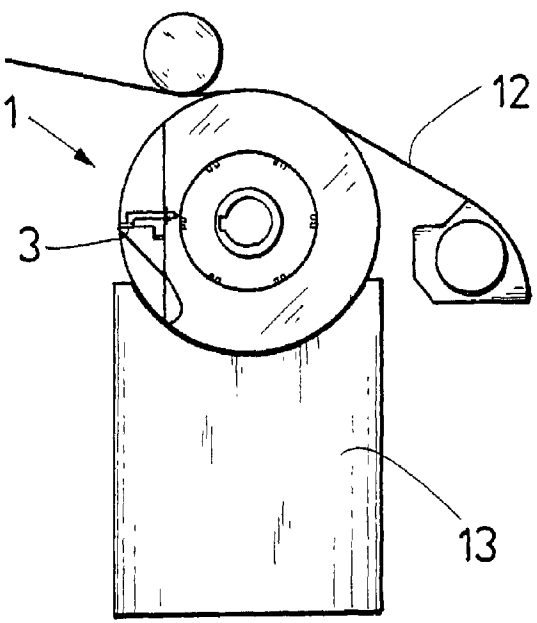
FIGS. 1A to 1C shows a device according to the invention in three different operating positions.
Figure 1B:
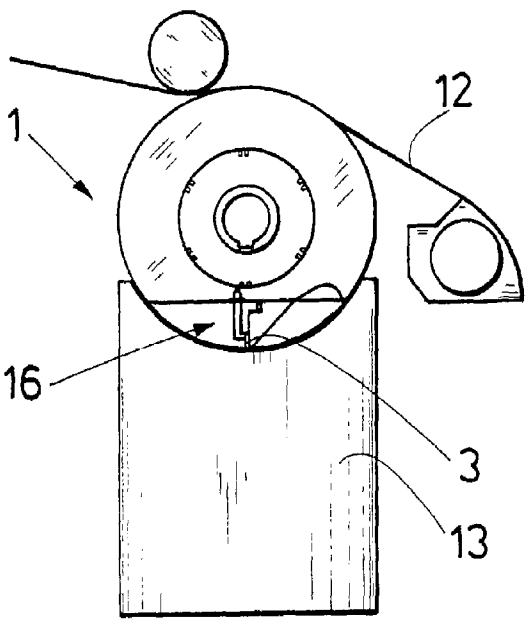
Figure 1A:
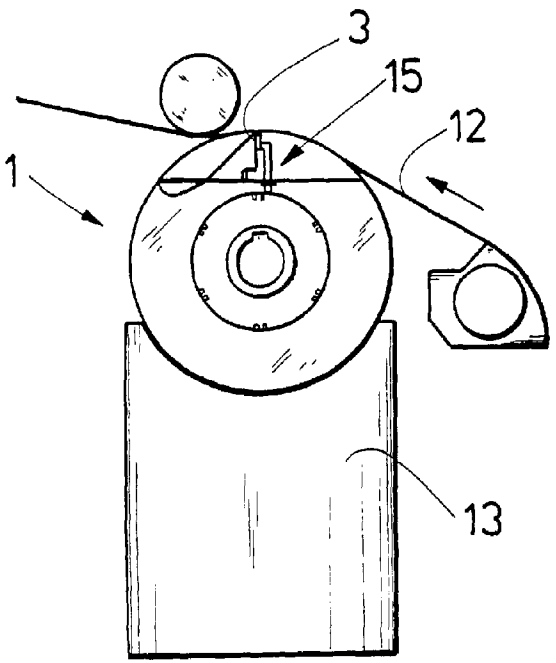

FIGS. 1A, 1B and 1C show three positions for a device 1 according to the present invention. The device 1 comprises a nozzle head or other glue-spreading element 3 and a cleaning apparatus 13 for the nozzle 3. The nozzle 3 and its operation has already been disclosed in the commonly owned German Application 100 19 930 A1, incorporated herein by reference.

FIG. 1A shows a working position 15 of the nozzle 3, in which a paper web 12 is moved in a direction of transport with the aid of rollers, for example, deflection rollers. The nozzle 3 is in the working position 15 (12 o'clock position) and correspondingly spreads a desired glue pattern onto one side the paper web 12.

The cleaning apparatus is preferably embodied as a washing container 13 that forms part of the device 1 and is arranged below the glue nozzle 3.

A cleaning position 16 for the device 1 is shown in FIG. 1B. For this position, the nozzle 3 has been moved from the working position 15 (FIG. 1A) into the cleaning position 16 by pivoting the nozzle 3 by 180°. The nozzle 3 is pointed downward (6 o'clock position). It is furthermore possible to carry out maintenance operations on the nozzle 3 if the nozzle 3 is pivoted, for example, by 90° (9 o'clock position), as shown in FIG. 1*c*.

Figure 2:
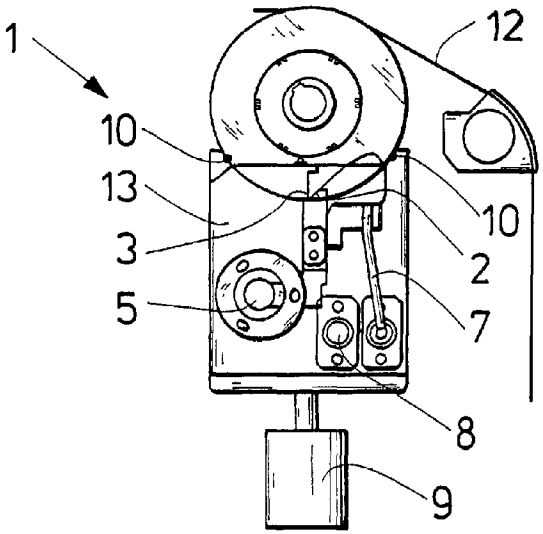
FIG. 2 shows a more detailed view of the device in the position of FIG. 1B.

FIG. 2 shows a detailed view of the device 1 in which the nozzle 3 of the glue-spreading device is in the cleaning position (6-o'clock position). The washing container 13 for the nozzle 3 is arranged below the downwardly pointing nozzle 3. The washing container 13 can be moved vertically up and down with the aid of compressed-air cylinders 9. Seals 10 seal off the washing container 13 in the upper side region, preferably on either side of the nozzle 3.

A scraper 2 that can be moved along the nozzle, preferably, the nozzle exit openings, is arranged inside the washing container 13. A scraper guide 5 is preferably formed inside the washing container 13 for moving the scraper 2, and the scraper 2 is preferably moved pneumatically along the scraper guide 5 with the aid of compressed air.

The washing container furthermore is provided with an intake and/or discharge line 8 for the intake and discharge of water or other cleaning liquid. An overflow outlet 7 is connected via a line to an ascending pipe 4 for measuring the liquid level inside the washing container 13. A filling level sensor 11 can be designed as capacitive or optical sensor and is arranged on the ascending pipe 4. The filling level sensor 11 can also be realized as a floater.

Figure 3:
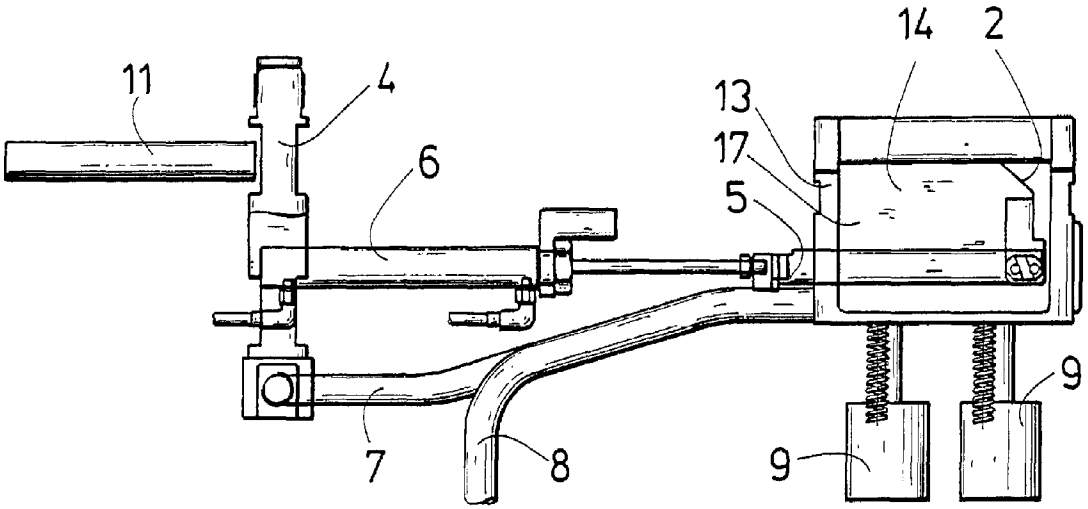
FIG. 3 shows a lateral view of the device of FIG. 2.

FIG. 3 shows a cross-sectional view from the side of the arrangement 1 in FIG. 2. The scraper 2 is connected via the guide 5 and rods to compressed-air cylinders 6 such that the scraper 2 can be moved inside the chamber 17 of washing container 13. The line 8 for the intake and discharge of fresh water and wastewater is attached to the washing container 13 such that the liquid 14 inside the chamber 17 is replaced following the cleaning of the nozzle head 3. As a result, the cleaned nozzle head 3 can be preserved in the watery environment until its next use.

A cleaning method in accordance with the present invention is described in the following with an example. Once the machine is stopped, the nozzle head 3 is moved from the working position 15 into the cleaning position 16. The washing container 13 can additionally be lowered for this, so that the nozzle head 3 can be pivoted into the cleaning position 16. The cleaning chamber 13 is then raised up to the nozzle head 3 and the intermediate space is sealed. The chamber 17 is subsequently filled with water until the scraper 2 and the glue nozzles are under water. The water intake and discharge can be controlled in accordance with a signal from the filling-level sensor 11. The scraper 2 moves along the nozzle head 3 and/or the guide 5 for cleaning the nozzle head 3 such that glue deposits or paper dust deposits are removed from the nozzle edge or the glue-discharge openings. The used water is then pumped via a line 8 into a container.

To preserve the nozzle head 3, the chamber 17 is filled with fresh water once the used water is pumped out.

The nozzle 3 and the glue inside the nozzle remains in the cleaning position 16 until the machine is restarted. If the water level does not drop, the glue in the nozzle is preserved. During the restart of the machine, the chamber is emptied and the nozzle 3 is subsequently pivoted into the working position 15. If the restart occurs following a relatively long shutdown, the glue can be pumped ahead of time into the washing container 13 while the nozzle 3 is in the cleaning position 16 to ensure that the glue is not thinned down by water.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device with a cleaning device and a glue spreading element in a machine of the tobacco processing industry where the glue-spreading element spreads glue in a working position onto a material web and is pivotable into a cleaning position, the device comprising:

a glue-spreading element that is pivotable into a cleaning position;

at least one movable scraper element for cleaning the glue-spreading element;

at least one chamber for holding a liquid, the at least one scraper element being arranged in the chamber;

means for adjusting the at least one chamber;

at least one means for pressing the scraper element against the glue-spreading element;

means for moving the scraper element in at least one of a linear direction and a crosswise direction relative to the glue-spreading element; and at least one means for sealing the chamber.

2. A device according to claim 1, further comprising at least one of means for intake of the liquid and means for discharge of the liquid.

3. A device according to claim 1, further comprising at least one sensor for sensing the liquid inside the chamber.

4. A device according to claim 1, wherein the means for moving the scraper element moves the scraper element at least one of hydraulically and pneumatically.

5. A device according to claim 3, wherein the chamber is provided with at least one overflow outlet.

* * * * *